US011375327B2

(12) United States Patent
Zucker et al.

(10) Patent No.: US 11,375,327 B2
(45) Date of Patent: Jun. 28, 2022

(54) SLEEP AIDING IN-EAR AUDIO DEVICE WITH NOISE-REDUCTION FINISH

(71) Applicant: Bose Corporation, Framingham, MA (US)

(72) Inventors: Natalie Zucker, Allston, MA (US); Han Zhang, Shrewsbury, MA (US); Nitzan Mokady, Boston, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/987,659

(22) Filed: Aug. 7, 2020

(65) Prior Publication Data

US 2022/0046370 A1 Feb. 10, 2022

(51) Int. Cl.
*H04R 25/00* (2006.01)
*H04R 1/10* (2006.01)

(52) U.S. Cl.
CPC ..... *H04R 25/652* (2013.01); *H04R 1/1016* (2013.01); *H04R 1/1058* (2013.01)

(58) Field of Classification Search
CPC .... H04R 1/1016; H04R 1/1058; H04R 1/345; H04R 1/1075; H04R 25/65
See application file for complete search history.

(56) References Cited

U.S. PATENT DOCUMENTS 9,820,064 B1 * 11/2017 Schumaier ..... B29C 33/3857
2003/0207092 A1 11/2003 Kim
2010/0122399 A1 * 5/2010 Odom ..... A42B 1/24 2/209.13
2019/0022348 A1 * 1/2019 Read ..... A61B 5/7257

FOREIGN PATENT DOCUMENTS

KR 20140100789 A 8/2014

OTHER PUBLICATIONS

PCT International Search Report and Written Opinion for International Application No. PCT/US2021/043135, dated Nov. 10, 2021, 25 pages.
Gideon Tim, "Jaybird Vista Review," PC Magazine, Jul. 31, 2019, 32 pages.
Unknown, "Pad printing," The Wayback Machine, Wikipedia, Jul. 10, 2020, 6 pages.

* cited by examiner

*Primary Examiner* — Amir H Etesam
(74) *Attorney, Agent, or Firm* — Hoffman Warnick LLC

(57) ABSTRACT

Various implementations include sleep aiding in-ear audio devices. Certain implementations include sleep aiding in-ear audio devices with a noise-reduction finish, along with methods of applying a noise reduction finish to an in-ear audio device. In some cases, a sleep aiding in-ear audio device includes: a set of earbuds, each earbud having: an eartip for mating with an ear of a user; and a housing coupled with the eartip, the housing containing an electro-acoustic transducer for providing an audio output to the user via the eartip, where when inserted in the ear of the user, substantially all of an exposed surface of the earbud is finished with a matte coating.

20 Claims, 3 Drawing Sheets

SLEEP AIDING IN-EAR AUDIO DEVICE WITH NOISE-REDUCTION FINISH

TECHNICAL FIELD

This disclosure generally relates to in-ear audio devices, sometimes referred to as earbuds. More particularly, the disclosure relates to mitigating undesirable rubbing and/or scratching noises for in-ear audio devices.

BACKGROUND

Sleep aiding in-ear audio devices have been shown to improve sleep patterns for users. Because these devices are designed to be worn during sleep, device designers aim to maximize user comfort when wearing such a device. However, conventional in-ear audio devices are still subject to rubbing and scratching, e.g., against fabrics such as pillows and blankets. This rubbing and/or scratching can irritate the device user, and reduce sleep aiding benefits.

SUMMARY

All examples and features mentioned below can be combined in any technically possible way.

Various implementations include sleep aiding in-ear audio devices. Certain implementations include sleep aiding in-ear audio devices with a noise-reduction finish, along with methods of applying a noise reduction finish to an in-ear audio device.

In some particular aspects, a sleep aiding in-ear audio device includes: a set of earbuds, each having: an eartip for mating with an ear of a user; and a housing coupled with the eartip, the housing containing an electro-acoustic transducer for providing an audio output to the user via the eartip, where when inserted in the ear of the user, substantially all of an exposed surface of the earbud is finished with a matte coating.

In other particular aspects, a sleep aiding in-ear audio device includes: a set of earbuds, each having: an eartip for mating with an ear of a user; a housing coupled with the eartip, the housing containing an electro-acoustic transducer for providing an audio output to the user via the eartip; and a decal affixed to an outer surface of the housing, wherein when inserted in the ear of the user, substantially all of an exposed portion of the outer surface is covered by the decal, and the decal has a matte finish.

In additional particular aspects, a method of applying a noise-reducing finish to an in-ear audio device includes: on a earbud having an eartip for mating with an ear of a user, and a housing coupled with the eartip, the housing containing an electro-acoustic transducer for providing an audio output to the user via the eartip, performing the following: applying a primer layer to an outer surface of the housing; pad printing a secondary layer over the primer layer; and applying a matte coating over a portion of the secondary layer, such that when inserted in the ear of the user, substantially all of an exposed surface of the earbud is finished with the matte coating.

In further particular aspects, a method of applying a noise-reducing finish to an in-ear audio device includes: on a earbud having an eartip for mating with an ear of a user, and a housing coupled with the eartip, the housing containing an electro-acoustic transducer for providing an audio output to the user via the eartip, performing the following: applying a Teflon decal to an outer surface of the housing, where the Teflon decal has a matte finish, and where when inserted in the ear of the user, substantially all of an exposed surface of the earbud is covered by the Teflon decal.

Implementations may include one of the following features, or any combination thereof.

In some cases, the in-ear audio device further includes a pad printed layer underlying the matte coating.

In particular aspects, the in-ear audio device further includes a molded plastic layer underlying the pad printed layer.

In certain implementations, when inserted in the ear of the user, the exposed surface protrudes from an outermost surface of the ear of the user by less than approximately several millimeters.

In particular cases, the matte coating mitigates detectable rubbing noise by the user when contacting a fabric.

In certain aspects, the fabric includes a pillow, a sheet, or a blanket.

In some implementations, the rubbing noise is in a frequency range of approximately: 100 Hertz (Hz) to approximately 1 kilo-Hertz (kHz).

In particular aspects, the matte coating covers approximately 20 percent or more an outer surface of the earbud.

In certain cases, the matte coating is transparent.

In some aspects, each eartip further includes a support member for retaining the earbud in position on the ear of the user.

In particular implementations, the housing further contains an electronics module coupled with the electro-acoustic transducer for controlling the audio output.

In certain cases, the in-ear audio device further includes a molded plastic layer underlying the decal.

In some aspects, when inserted in the ear of the user, the decal protrudes from an outermost surface of the ear of the user by less than approximately several millimeters.

In certain cases, the decal covers approximately 15 percent or more of the outer surface of the earbud.

In particular implementations, the decal includes Teflon and is transparent.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
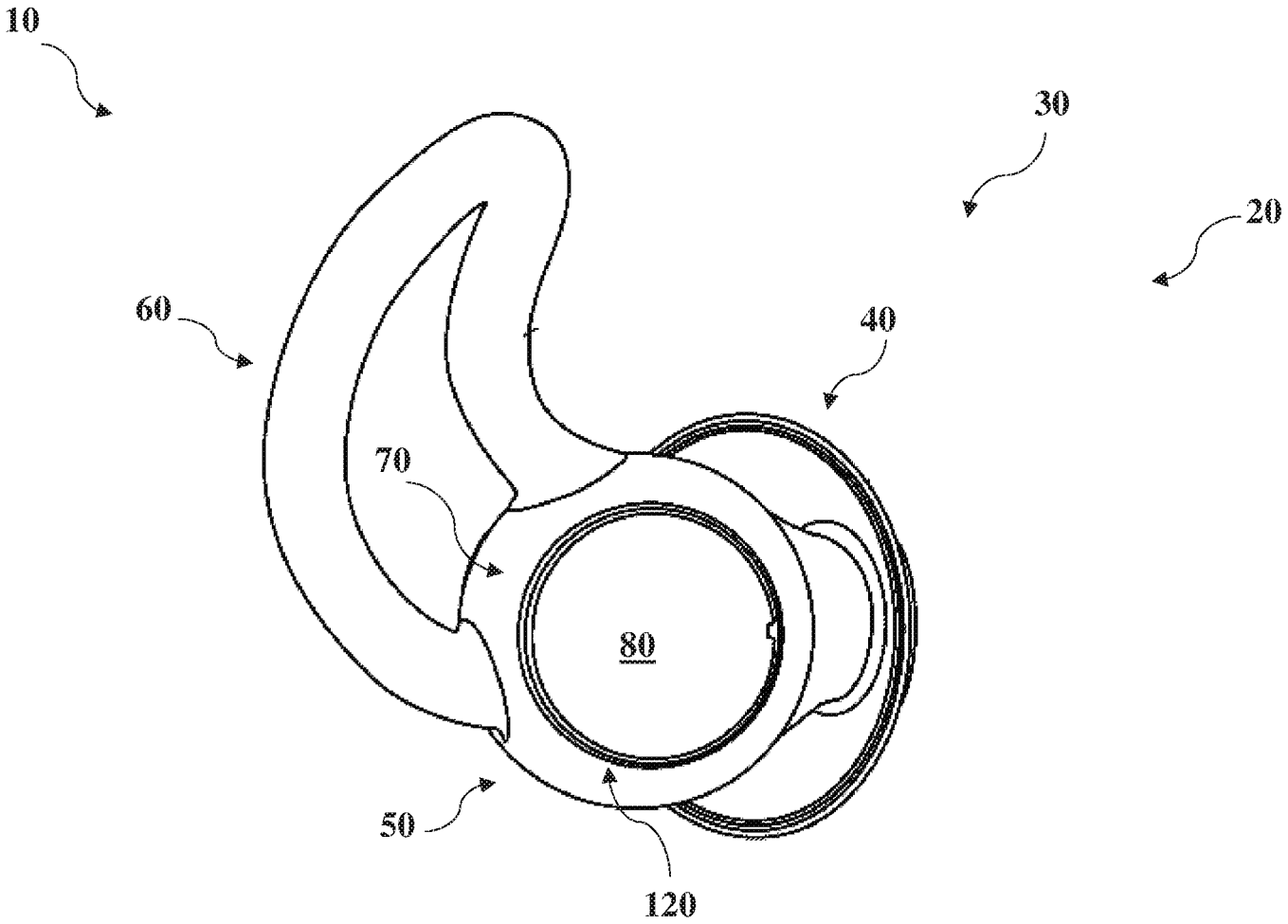
FIG. 1 is a schematic depiction of an example in-ear audio device according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a matte coating and/or a matte decal can be applied to an exposed surface of a sleep aiding in-ear audio device (or, earbud) to mitigate rubbing and/or scratching noise. In certain implementations, a sleep aiding in-ear audio device includes a matte coating or a matte decal covering substantially all of the exposed surface of the earbud when inserted in the user's ear.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value +/− a margin of error, such as a measurement error, which may range from up to 1-5 percent.

Aspects and implementations disclosed herein may be applicable to a wide variety of wearable audio devices in various form factors, such as head-worn devices (e.g., headsets, headphones, earphones, eyeglasses, helmets, hats, visors,), neck-worn speakers, shoulder-worn speakers, body-worn speakers (e.g., watches), etc. Some particular aspects disclosed may be applicable to personal (wearable) audio devices such as in-ear audio devices, or earbuds. It should be noted that although specific implementations of audio devices primarily serving the purpose of acoustically outputting audio are presented with some degree of detail, such presentations of specific implementations are intended to facilitate understanding through provision of examples and should not be taken as limiting either the scope of disclosure or the scope of claim coverage.

The wearable audio devices disclosed herein can include additional features and capabilities not explicitly described. These wearable audio devices can include additional hardware components, such as one or more cameras, location tracking devices, microphones, etc., and may be capable of voice recognition, visual recognition, and other smart device functions. The description of wearable audio devices included herein is not intended to exclude these additional capabilities in such a device.

FIG. 1 is a schematic depiction of a first example audio device 10. In this example, the audio device 10 is an audio headset 20 having at least one earbud (or, in-ear headphone) 30. One earbud 30 is illustrated in this example. As described herein, the audio device 10 can include a sleep aiding in-ear audio device that is configured to provide an audio output to enhance a user's sleep pattern(s). In certain implementations, the audio device 10 includes or is otherwise connected with a memory and/or processor for providing sleep aiding audio output (e.g., as audio tracks and/or audio streams). While the earbud 30 is shown in a "true" wireless configuration (i.e., without tethering between earbuds 30), the audio headset 20 could also include a tethered wireless configuration (whereby earbuds 30 are connected via wire with a wireless connection to a playback device) or a wired configuration (whereby at least one of the earbuds 30 has a wired connection to a playback device). Each earbud 30 can include an eartip 40 for mating with an ear of a user. In some cases, the eartip 40 is referred to as a nozzle, and is sized to insert into the user's ear canal entrance. In certain cases, the earbud 30 includes a housing 50 coupled with the eartip 40. The housing 50 can include an electronics module, such as an electro-acoustic transducer for providing an audio output to the user via the eartip 40. As noted herein, the audio output can include a sleep-aiding audio output in particular implementations. In certain cases, the earbud 30 also includes a support member 60 for retaining the eartip 40 in a resting position within the user's ear. In some cases, separate, or duplicate sets of electronics are contained in portions of the earbuds 30, e.g., each of the respective earbuds 30. However, certain components described herein can also be present in singular form.

As can be seen in FIG. 1, each earbud 30 is sized and shaped to fit snugly in the user's ear, such that a majority of the earbud fits within the distal outer dimension of the user's ear. This low-profile configuration enables the user to comfortably wear the earbud 30 while sleeping. However, despite the low-profile configuration, at least a portion of the earbud 30 is likely to contact a user's pillow or blanket while she sleeps. That is, a portion of the earbud 30 is exposed when the earbud 30 is inserted in the user's ear. For example, as depicted in FIG. 1, a surface 70 of the earbud 30 will be exposed when inserted into the ear of a user. In certain cases, when inserted in the ear of the user, the surface 70 protrudes from the outermost surface of the ear of the user by less than approximately several millimeters (e.g., where a total height of the earbud 30 is less than approximately 10 millimeters).

The exposed surface 70 is positioned such that when the user rests her head on its side, e.g., with one ear contacting a surface such as pillow, blanket, mattress, etc., that exposed surface 70 is likely to contact the underlying surface. In many instances, the surface of the pillow, sheet, blanket, mattress, etc., includes a fabric such as cotton, silk or a synthetic. In conventional earbuds, contact between an exposed surface and a fabric can cause a rubbing and/or scratching noise that is audible to the user. This rubbing and/or scratching noise can disrupt sleep patterns and detract from the benefits of a low profile earbud. In various implementations, the rubbing and/or scratching noise is in a frequency range of approximately: 100 Hertz (Hz) to approximately 1 kilo-Hertz (kHz).

In contrast to conventional earbuds, earbud(s) 30 have an exposed surface 70 that is substantially finished with a matte coating 80 that mitigates detectable rubbing and/or scratching noise by the user, e.g., when interacting with (contacting) a fabric. In particular, at least a portion of the outer surface of the housing 50 has a matte coating 80 that mitigates detectable rubbing and/or scratching by the user when interacting with a fabric. The matte coating 80 is transparent in various implementations. In certain cases, the matte coating 80 includes: polyurethane or a polyurethane based paint, and/or another coating that has a grade of 2 or lower (mildly reactive) on a cytotoxicity scale (e.g., according to international standards: ANSI/AAMI/ISO 10993-5). In certain cases, the matte coating 80 has a grade of 1 or lower on a cytotoxicity scale such as ANSI/AAMI/ISO 10993-5.

Figure 2:
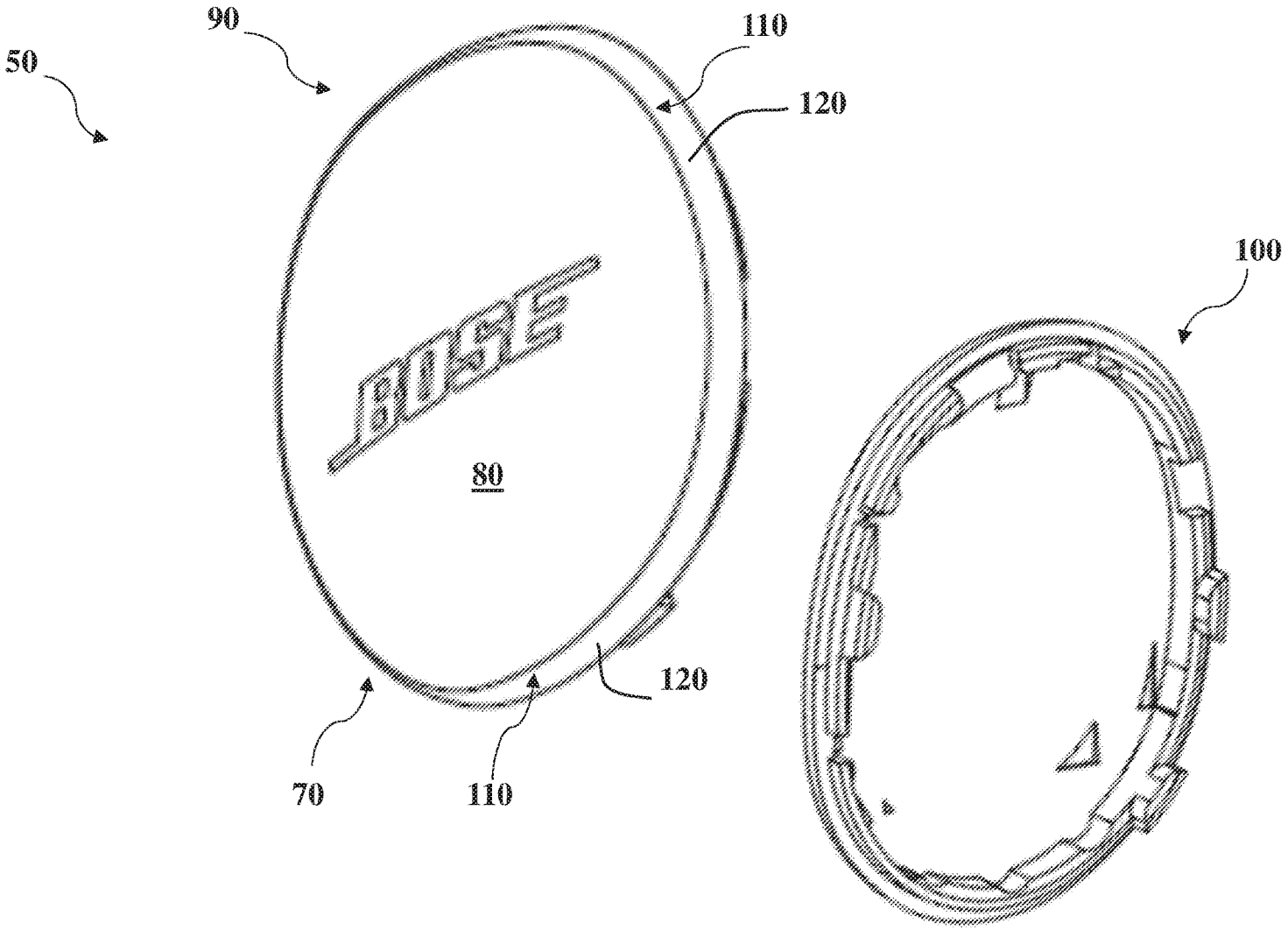
FIG. 2 is a separated perspective view of a housing in the in-ear audio device of FIG. 1, according to various implementations.

FIG. 2 shows a separated perspective view of the housing 50 in an earbud 30 (FIG. 1) according to various implementations. The housing 50 has a top cap 90 and a bottom cap 100 that couple to contain portions of the electronics. The top cap 90 includes the exposed surface 70, and is formed of a molded plastic layer 110 (which can include several layers of molded plastic, in some cases). Over the molded plastic layer 110 is a pad printed layer (obscured in this view). Finally, over the pad printed layer is the matte coating 80 that covers substantially all of the exposed surface 70. In particular cases, the term "substantially all" means approximately 75 percent, 80 percent, 90 percent, 95 percent or more of the exposed surface 70 is covered with the matte coating 80. In particular cases, approximately 90-95 percent or more of the exposed surface 70 of the housing 50 is covered by the matte coating 80. In certain cases, the exposed surface 70 is approximately planar or arced, and includes a border 120 that has a distinct slope from the exposed surface 70. In certain cases, the border 120 is covered in the matte coating 80. In other cases, the border 120 includes the molded plastic layer 110 without the matte coating 80. In particular cases, relative to the entire outer surface of the earbud 30 when removed from the user's ear (FIG. 1), approximately 20 percent or more (e.g., approximately 20 percent, 30 percent, 40 percent, 50 percent or 60 percent) of that outer surface is covered with the matte coating 80.

Figure 3:
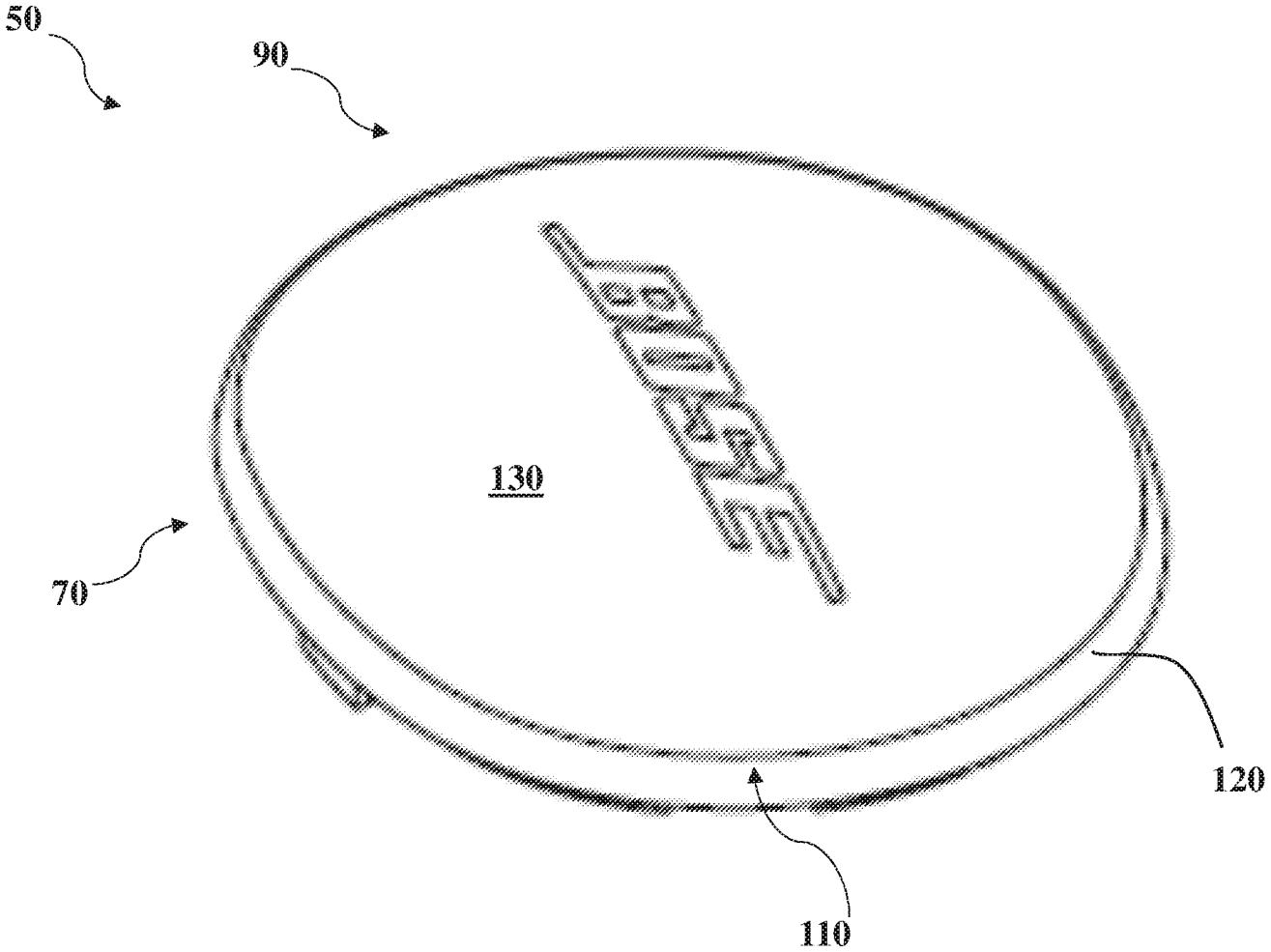
FIG. 3 is a perspective view of a portion of a housing in the in-ear audio device of FIG. 1, according to various additional implementations.

FIG. 3 illustrates another implementation, whereby the matte coating 80 on the exposed surface 70 of the housing 50 is replaced with a decal 130 that has a matte finish. In these implementations, the decal 130 is affixed to the outer surface of the housing 50, e.g., to the molded plastic layer 110. In various implementations, the decal 130 is directly affixed to the molded plastic layer 110, and covers substantially the entirety of the exposed surface 70 of the earbud 30 when placed in the user's ear, such that substantially all of the exposed surface 70 has a matte finish. In certain cases, relative to the entire outer surface of the earbud 30 when removed from the user's ear (FIG. 1), approximately 15 percent or more (e.g., approximately 20 percent, 30 percent or 40 percent) of that outer surface is covered with the decal 130. In particular implementations, the decal 130 includes Teflon. In various implementations, the decal 130 includes an adhesive (e.g., such as a transfer tape or double coated tape) that is sufficient to couple the decal 130 with the molded plastic layer 110. In certain implementations, a separate adhesive (e.g., an epoxy, adhesive primer layer, transfer tape and/or double coated tape) is applied between the decal 130 and the molded plastic layer 110. In certain cases, the decal 130 is transparent.

The earbuds 30, including the matte coating 80 (FIG. 2) or the decal 130 (FIG. 3), can be formed according to various methods. For example, a first method of forming the earbud 30 with the matte coating 80 includes: a) applying a primer layer to an outer surface of the housing 50, e.g., over the molded plastic layer 110 on the housing 50; b) pad printing at least one secondary layer over the primer layer; and c) applying the matte coating 80 over a portion of the secondary layer (e.g., over the exposed surface 70 or substantially all of the exposed surface 70). In certain examples, one or more secondary layers are applied over the primer under the matte coating 80. In certain cases, the secondary layer(s) is only applied to a portion of the primer layer.

An additional method of forming an exposed surface 70 with a matte finish can include: applying a Teflon decal to an outer surface of the housing, e.g., over the molded plastic layer 110 on the housing 50. In various implementations, the Teflon decal (e.g., decal 130) is coupled with the molded plastic layer 110 using an integral adhesive. In other cases, the Teflon decal (e.g., decal 130) is coupled with the molded plastic layer 110 using an interposed adhesive layer.

In any case, the earbuds 30 shown and described according to various implementations are configured to enhance the user experience when compared with conventional earbuds. For example, earbuds 30 that have a matte finish or a matte decal on surface(s) that are exposed while worn on the user's ear can mitigate scratching and/or rubbing noises experienced by the user when worn during sleep or when otherwise contacting an external surface such as a fabric. The matte finish or matte decal can be applied in a low-profile manner to an earbud, e.g., maintaining the usefulness of the earbud as a sleep assisting in-ear audio device.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

We claim:

1. A sleep aiding in-ear audio device, comprising:
a set of earbuds, each earbud comprising:
an eartip for mating with an ear of a user; and
a housing coupled with the eartip, the housing containing an electro-acoustic transducer for providing an audio output to the user via the eartip,
wherein when inserted in the ear of the user, substantially all of an exposed surface of the earbud is finished with a matte coating, and
wherein the matte coating mitigates detectable rubbing noise by the user when contacting a fabric.

2. The in-ear audio device of claim 1, further comprising a pad printed layer underlying the matte coating.

3. The in-ear audio device of claim 2, further comprising a molded plastic layer underlying the pad printed layer.

4. The in-ear audio device of claim 1, wherein when inserted in the ear of the user, the exposed surface protrudes from an outermost surface of the ear of the user by less than approximately several millimeters.

5. The in-ear audio device of claim 1, wherein the fabric comprises a pillow, a sheet, or a blanket.

6. The in-ear audio device of claim 1, wherein the matte coating covers approximately 20 percent or more of an outer surface of the earbud.

7. The in-ear audio device of claim 1, wherein the matte coating is transparent.

8. The in-ear audio device of claim 1, wherein each eartip further comprises a support member for retaining the earbud in position on the ear of the user.

9. A sleep aiding in-ear audio device, comprising:
a set of earbuds, each earbud comprising:
an eartip for mating with an ear of a user;
a housing coupled with the eartip, the housing containing an electro-acoustic transducer for providing an audio output to the user via the eartip; and
a decal affixed to an outer surface of the housing, wherein when inserted in the ear of the user, substantially all of an exposed portion of the outer surface is covered by the decal, and wherein the decal has a matte finish, wherein the matte finish mitigates detectable rubbing noise by the user when contacting a fabric.

10. The in-ear audio device of claim 9, further comprising a molded plastic layer underlying the decal.

11. The in-ear audio device of claim 9, wherein when inserted in the ear of the user, the decal protrudes from an outermost surface of the ear of the user by less than approximately several millimeters.

12. The in-ear audio device of claim 9, wherein the fabric comprises a pillow, a sheet, or a blanket.

13. The in-ear audio device of claim 9, wherein the decal covers approximately 15 percent or more of the outer surface of the earbud.

14. The in-ear audio device of claim 9, wherein the decal comprises Teflon and is transparent.

15. The in-ear audio device of claim 6, wherein when inserted in the ear of the user, the exposed surface of the earbud is approximately planar or arced, and wherein the earbud further comprises a border around the exposed surface of the earbud, the border having a distinct slope from a slope of the planar or arced exposed surface.

16. The in-ear audio device of claim 13, wherein when inserted in the ear of the user, the exposed surface of the earbud is approximately planar or arced, and wherein the earbud further comprises a border around the exposed surface of the earbud, the border having a distinct slope from a slope of the planar or arced exposed surface.

17. A sleep aiding in-ear audio device, comprising:

a set of earbuds, each earbud comprising:

an eartip for mating with an ear of a user; and a housing coupled with the eartip, the housing containing an electro-acoustic transducer for providing an audio output to the user via the eartip, wherein when inserted in the ear of the user, substantially all of an exposed surface of the earbud is finished with a matte coating, wherein the matte coating covers approximately 20 percent or more of an outer surface of the earbud, and wherein when inserted in the ear of the user, the exposed surface of the earbud is approximately planar or arced, and wherein the earbud further comprises a border around the exposed surface of the earbud, the border having a distinct slope from a slope of the planar or arced exposed surface.

18. The in-ear audio device of claim 17, wherein the matte coating is transparent.

19. A sleep aiding in-ear audio device, comprising:

a set of earbuds, each earbud comprising:

an eartip for mating with an ear of a user;

a housing coupled with the eartip, the housing containing an electro-acoustic transducer for providing an audio output to the user via the eartip; and a decal affixed to an outer surface of the housing, wherein when inserted in the ear of the user, substantially all of an exposed portion of the outer surface is covered by the decal, and wherein the decal has a matte finish, wherein the decal covers approximately 15 percent or more of the outer surface of the earbud, and wherein when inserted in the ear of the user, the exposed surface of the earbud is approximately planar or arced, and wherein the earbud further comprises a border around the exposed surface of the earbud, the border having a distinct slope from a slope of the planar or arced exposed surface.

20. The in-ear audio device of claim 19, wherein when inserted in the ear of the user, the decal protrudes from an outermost surface of the ear of the user by less than approximately several millimeters.

* * * * *